United States Patent [19]

Korcz et al.

[11] Patent Number: 4,664,285

[45] Date of Patent: May 12, 1987

[54] METAL RING CLIP FOR ENDCAPPING OF CONTAINER

[75] Inventors: William H. Korcz, Houston, Tex.; Surendra N. Singhal, Tulsa, Okla.

[73] Assignee: Shell Oil Company, Houston, Tex.

[21] Appl. No.: 909,538

[22] Filed: Sep. 22, 1986

[51] Int. Cl.[4] ..... B65D 53/00

[52] U.S. Cl. ..... 220/67; 220/73

[58] Field of Search ..... 220/67, 66, 73, 76, 220/79, 80

[56] References Cited

U.S. PATENT DOCUMENTS

| | | | |
|---|---|---|---|
| 749,319 | 1/1904 | McLaughlin | 220/67 |
| 2,389,534 | 11/1945 | O'Brien | 220/67 X |
| 2,598,962 | 6/1952 | Anseele | 220/73 X |
| 2,810,492 | 10/1957 | Bergen et al. | 220/67 X |
| 3,288,342 | 11/1966 | Tinker | 220/67 X |
| 3,505,722 | 4/1970 | Ullman | 220/67 X |
| 3,955,705 | 5/1976 | Dubois et al. | 220/67 |
| 4,457,465 | 7/1984 | Shepard et al. | 220/67 X |

*Primary Examiner*—Steven M. Pollard

*Attorney, Agent, or Firm*—Jennifer R. Ross

[57] ABSTRACT

A substantially metal ring clip for attachment to the sidewall of the thermoplastic food or beverage container to enable a metal end to be attached to the thermoplastic sidewall without flaring of the thermoplastic sidewall comprises a first wall having a first edge and a second edge, where the second wall is positioned outside of and adjacent to the first wall, a third annular wall positioned substantially perpendicular to the first wall and the second wall, and having an inner and outer edge, where the inner edge is connected to the first edge of the second annular wall and the outer edge is connected to the first edge of the first annular wall, a fourth annular wall having an inner and outer edge, where the inner edge is connected to the first edge of the second annular wall, and wherein the first and second annular walls are arranged concentric to a central longitudinal axis. The outer edge of the fourth annular wall may be above or below a latitudinal axis which axis is perpendicular to the second wall at the first edge of the second wall. The first and second walls are preferably annular rings.

7 Claims, 13 Drawing Figures

FIG.1
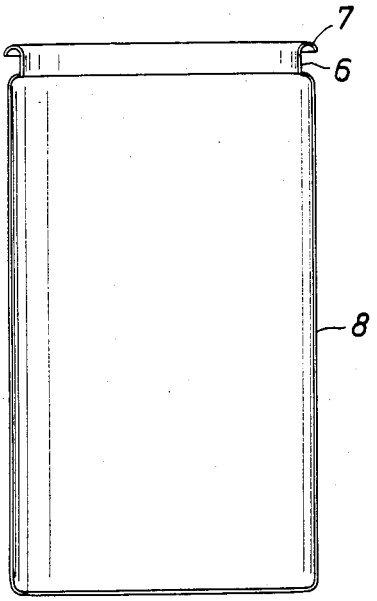
FIG. 2
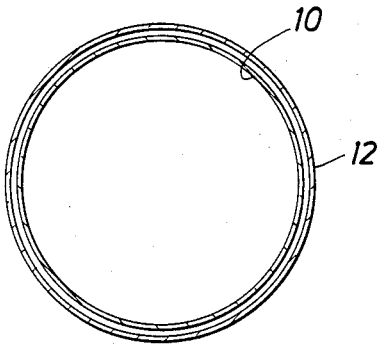
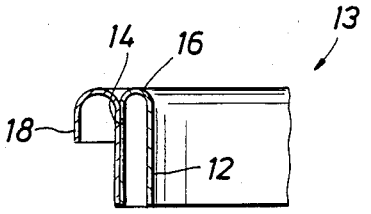
FIG. 3
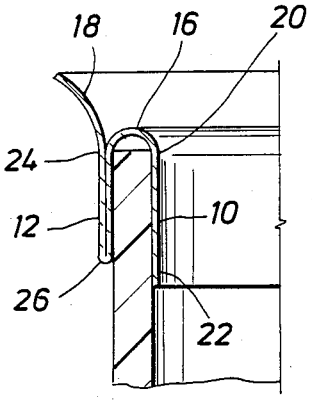
FIG.4
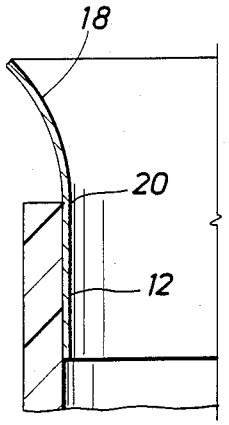
FIG.5
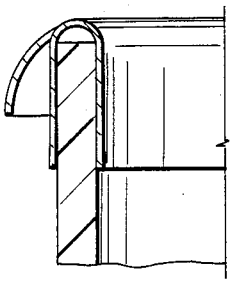
FIG.6
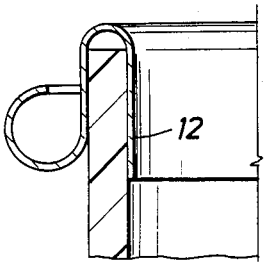
FIG.7
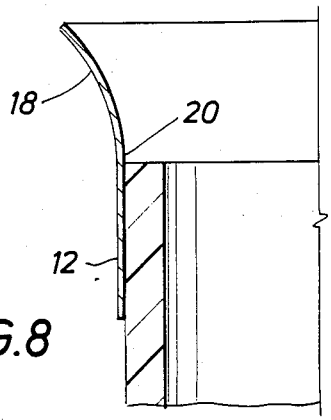
FIG.8

FIG. 9
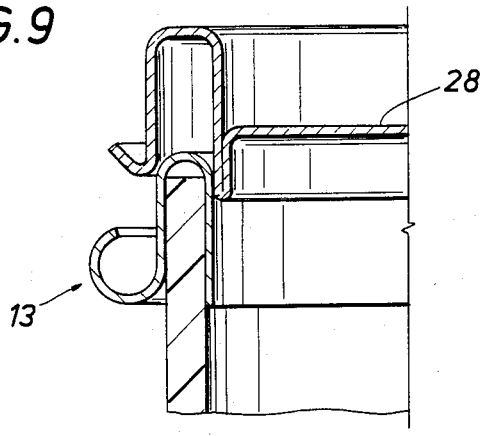
FIG. 10
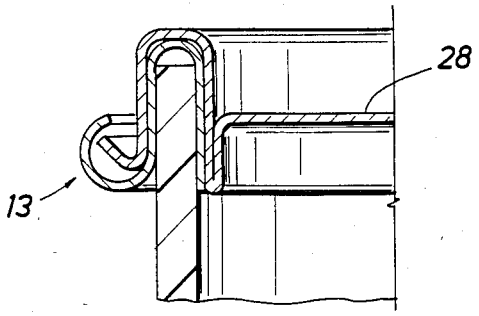
FIG. 11
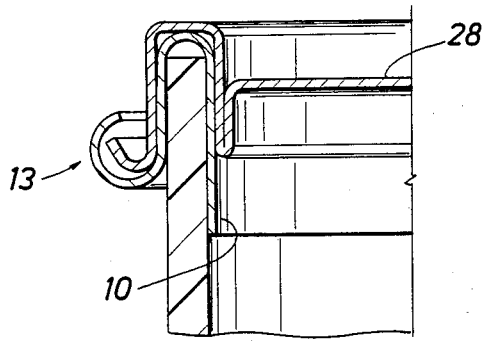
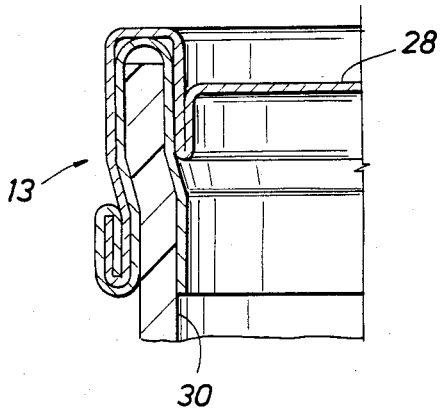
FIG. 12
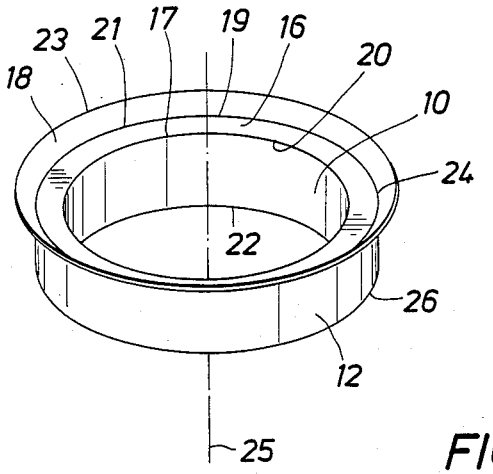
FIG. 13

METAL RING CLIP FOR ENDCAPPING OF CONTAINER

BACKGROUND OF THE INVENTION

The present invention relates to a ring clip which may be attached to the sidewall of a thermoplastic container to enable a metal end to be attached to the sidewall.

Containers are made of many materials. Until recently, food and beverage containers in particular were often made of a metal such as aluminum. The sidewalls of the containers are made and then metal ends are attached to the metal sidewalls by some means, such as mechanical double seaming. In doing this, the metallic can sidewalls are flanged (flared or bent around the neck area) so that the ends may be double seamed.

Recently, the advent of plastic containers, such as plastic pressurized beverage containers, has posed new problems in attaching a metallic end to thermoplastic can bodies.

Flaring of the neck area of the sidewalls of plastic can bodies causes undesirable damage to the body and makes it difficult to fit and attach the conventional metallic lid onto the plastic body. Permanent flanges of uniform dimensions are also difficult for plastic can bodies owing to plastic memory of the sidewall.

SUMMARY OF THE INVENTION

A substantially metal ring clip for attachment to the sidewall of the thermoplastic food or beverage container to enable a metal end to be attached to the thermoplastic sidewall without flaring of the thermoplastic sidewall comprises a first wall having a first edge and a second edge, where the second wall is positioned outside of and adjacent to the first wall, a third annular wall positioned substantially perpendicular to the first wall and the second wall, and having an inner and outer edge, where the inner edge is connected to the first edge of the second annular wall and the outer edge is connected to the first edge of the first annular wall, a fourth annular wall having an inner and outer edge, where the inner edge is connected to the first edge of the second annular wall, and wherein the first and second annular walls are arranged concentric to a central longitudinal axis. The outer edge of the fourth annular wall may be above or below a latitudinal axis which axis is perpendicular to the second wall at the first edge of the second wall. The first and second walls are preferably annular rings.

BRIEF DESCRIPTION OF THE DRAWINGS

FIG. 1 shows a metal can body with a flared neck.

FIG. 2 shows a top view of the metal ring clip of the present invention.

FIG. 3 shows a side view of the metal ring clip.

FIG. 4 shows a side view of a metal ring clip variation.

FIG. 5 shows a side view of a metal ring clip variation.

FIG. 6 shows a side view of a metal ring clip variation.

FIG. 7 shows a side view of a metal ring clip variation.

FIG. 8 shows a side view of a metal ring clip variation.

FIG. 9 shows the placement of the metal lid against and into position with the metal ring clip.

FIG. 10 shows the metal lid in position with the metal ring clip.

FIG. 11 shows another embodiment of the lid positioned with the metal ring clip.

FIG. 12 shows another embodiment of the lid positioned with the metal ring clip where the container sidewalls, ring clip and lid are bent inward.

FIG. 13 is an angular view of said metal ring clip.

DETAILED DESCRIPTION OF THE INVENTION

A metallic ring clip has been designed to provide a desirable match between the thermoplastic sidewalls of a container and a conventional metallic lid. In this way, the body of the plastic can need not be flared, thus avoiding any damage to it but a simulated flared surface is provided by the metallic ring clip so that the metal lid can be attached to the plastic sidewalls employing existing double seaming equipment.

FIG. 1 shows a typical metal can with a flared neck to which is attached a metallic lid by double seaming the lid to the flared neck.

In FIG. 2, a cross section view of one embodiment of the metal ring clip is shown. A first wall is provided, preferably as an annular ring, with a second wall 12, preferably an annular ring being positioned outside of and adjacent to first wall 10.

FIG. 3 shows a side view of one variation of the metal ring clip. First annular ring 12 is surrounded by second annular ring 14 between which is a third annular ring 16. A fourth annular ring 18 is attached to said second annular ring 14.

FIG. 4 is a variation of the metal ring clip where the outer edge of annular ring 18 is above a latitudinal axis where the latitudinal axis is perpendicular to the second annular ring at the first edge of the second annular ring.

FIG. 5 is a side view variation of the metal ring clip showing first annular ring 12 attached to the inside of the thermoplastic container sidewall and flared annular ring 18 attached to first annular ring 12 at first edge 20 of said annular ring 12 and said annular ring 18.

FIG. 6 is in further variation of the metal ring clip.

FIG. 7 is still another variation of the metal ring clip.

FIG. 8 is similar to FIG. 5 except the first annular ring 12 is attached to the outer thermoplastic sidewall of the container. As may be seen, fourth annular ring 18 may be positioned in an upward flared manner, a downward flared manner and downward and curled as seen in FIG. 7. Any suitable shape or position of annular ring 18 which will allow bonding of the metallic lid to the ring clip is appropriate.

FIG. 9 shows the placement of the metal lid 28 against a partially metal ring clip 13.

FIG. 10 shows lid 28 positioned with metal ring clip 13.

FIG. 11 shows lid 28 positioned with metal ring clip 13 where the first annular ring 10 of the metal ring clip 13 is extended below lid 28.

FIG. 12 is a further embodiment of the lid 28 positioned with the metal ring clip 13 where the thermoplastic sidewall of the container 8, as well as part of the end 28 and body clip 13 are indented.

FIG. 13 is an angular view of the ring clip. First annular ring 10 has a first edge 20 and a second edge 22. Second annular ring 12 has a first edge 24 and a second edge 26. The second annular ring 12 is positioned outside of and adjacent to the first annular ring 10. A third annular ring 16 is positioned substantially perpendicular to said first annular ring 10 and said second annular ring 12, having an inner edge 17 and an outer edge 19 where the inner edge 17 is connected to the first edge 20 of the first annular ring 10 and the outer edge 19 is connected to the first edge 24 of the second annular ring 12. A fourth annular ring 18 has inner edge 21 and outer edge 23 where the inner edge 21 is connected to the first edge 24 of the second annular ring 12 and where the first annular ring 10 and the second annular ring 12 are arranged concentric to a central longitudinal axis 25.

The outer edge 23 of fourth annular ring 18 may be above a latitudinal axis where the latitudinal axis is perpendicular to the second annular ring 12 at the first edge 24 of second annular ring 12. Likewise, the outer edge 23 of fourth annular ring 18 may be below this latitudinal axis. This is illustrated in the various embodiments in FIGS. 4 through 8.

The annular walls or rings are formed so they provide a continuous metallic surface. This design allows the usage of a currently marketed metallic lid without any alterations in its design.

Manufacturing of the clip—a thin shell may be cut from metal stock and then bent to obtain the desired shape as seen in FIG. 3. This leads to doubling of the clip surface of the second annular ring 12. Alternatively, the desired sections may be punched out using a die.

The ring clip should be substantially metal, for example, aluminum or steel. A continuous operation can provide a multitude of these rings at a very fast rate which could then be cut to desired length and directly fed to the end-seaming equipment.

Other embodiments and variations of this invention will be apparent to one of ordinary skill in the art.

What is claimed:

1. A substantially metal ring clip for attachment to the sidewall of a thermoplastic food or beverage container to enable a metal end to be attached to the thermoplastic sidewall without flaring of the thermoplastic sidewall, said ring clip comprising:

a first wall having a first edge and a second edge;

a second wall having a first edge and a second edge, said second wall being positioned outside of and adjacent to said first wall;

a third annular wall positioned substantially perpendicular to said first wall and said second wall, and having an inner and outer edge, where said inner edge is connected to said first edge of said first annular wall, and said outer edge is connected to said first edge of said second annular wall;

a fourth annular wall having an inner and outer edge, where said inner edge is connected to said first edge of said second annular wall; and wherein said first and second annular walls are arranged concentric to a central longitudinal axis.

2. The ring clip of claim 1, wherein said outer edge of said fourth annular wall is above a latitudinal axis, said axis being perpendicular to said second wall at said first edge of said second wall.

3. The ring clip of claim 1, wherein said outer edge of said fourth annular wall is below a latitudinal axis, said axis being perpendicular to said second wall at said first edge of said second wall.

4. The ring clip of claim 1, wherein said first wall forms a first annular ring defined about said central longitudinal axis and said second wall forms a second annular ring defined about said central longitudinal axis.

5. A substantially metal ring clip for attachment to the sidewall of a thermoplastic food or beverage container to enable a metal end to be attached to the thermoplastic sidewall without flaring of the thermoplastic sidewall, said ring clip comprising:

a first annular ring having a first edge and a second edge;

a second annular ring having a first edge and a second edge, said second wall being positioned outside of and adjacent to said first wall;

a third annular wall positioned substantially perpendicular to said first wall and said second wall, and having an inner and outer edge, where said inner edge is connected to said first edge of said first annular wall, and said outer edge is connected to said first edge of said second annular wall;

a fourth annular wall having an inner and outer edge, where said inner edge is connected to said first edge of said second annular wall; and wherein said first and second annular walls are arranged concentric to a central longitudinal axis.

6. The ring clip of claim 5, wherein said outer edge of said fourth annular wall is above a latitudinal axis, said axis being perpendicular to said second annular ring at said first edge of said second annular ring.

7. The ring clip of claim 5, wherein said outer edge of said fourth annular wall is below a latitudinal axis, said axis being perpendicular to said second annular ring at said first edge of said second annular ring.

* * * * *